US007798303B1

(12) United States Patent
Chang

(10) Patent No.: US 7,798,303 B1
(45) Date of Patent: Sep. 21, 2010

(54) MULTI-COIN OPERATED ACTUATION MECHANISM

(76) Inventor: Kil Jae Chang, T.PiCo, Korea Co., Ltd., 321-37 Suksu, 2 Dong, Anyang City, Kyungkido (KR)

( * ) Notice: Subject to any disclaimer, the term of this patent is extended or adjusted under 35 U.S.C. 154(b) by 148 days.

(21) Appl. No.: 11/982,897

(22) Filed: Nov. 6, 2007

Related U.S. Application Data

(60) Provisional application No. 60/967,629, filed on Sep. 6, 2007.

(51) Int. Cl.
*G07F 5/04* (2006.01)

(52) U.S. Cl. ..... 194/293

(58) Field of Classification Search ..... 194/293, 194/232, 237, 253
See application file for complete search history.

(56) References Cited

U.S. PATENT DOCUMENTS

| | | | | |
|---|---|---|---|---|
| 3,010,557 | A | 11/1961 | Weitzman | |
| 3,970,181 | A | 7/1976 | Rubio | |
| 4,350,239 | A * | 9/1982 | Tsuiki | 194/295 |
| 4,673,074 | A | 6/1987 | McCormick | |
| 4,798,558 | A * | 1/1989 | Bellis | 453/32 |
| 4,899,864 | A * | 2/1990 | Van Horn | 194/237 |
| 5,070,986 | A * | 12/1991 | Hoffman et al. | 194/237 |
| 5,188,207 | A * | 2/1993 | Hoffman | 194/236 |
| 6,964,328 | B2 * | 11/2005 | Santilli et al. | 194/202 |
| 7,222,711 | B2 | 5/2007 | Chang | |
| 2002/0117374 | A1 * | 8/2002 | Li et al. | 194/232 |

* cited by examiner

*Primary Examiner*—John Q. Nguyen
*Assistant Examiner*—Mark Beauchaine
(74) *Attorney, Agent, or Firm*—John R. Flanagan

(57) ABSTRACT

A multi-coin operated actuation mechanism includes an interchangeable coin carrier wheel having a coin receiving recess of a width different from that of another wheel such that a different number of coins can be deposited into coin accepting regions of the recess. The wheel has an outer segment on its peripheral edge defining either an abutment surface or a camming surface at an outer trailing end of the recess correspondingly aligned with the coin accepting region or a non-accepting region of the recess defined adjacent to the accepting region. Also, coin periphery sensing dogs are pivotally mounted side-by-side and match the maximum number of the multiple coins. The dogs have outer tip surfaces substantially identical and correspondingly aligned with and adapted to engage outer segments on the peripheral edge of the wheel to prevent or allow movement of the wheel past them depending upon whether the multiple coins are present or not in the recess.

17 Claims, 8 Drawing Sheets

MULTI-COIN OPERATED ACTUATION MECHANISM

This patent application claims benefit of U.S. provisional application No. 60/967,629 filed Sep. 6, 2007.

CROSS-REFERENCE TO RELATED APPLICATION

Cross-reference is hereby made to a copending patent application by the same inventor, entitled "Coin-Operated Actuation Mechanism With Anti-Vandalism Device", assigned Ser. No. 11/982,939 and filed on Nov. 6, 2007, the same date of filing as this patent application, which discloses subject matter in common with this patent application.

BACKGROUND OF THE INVENTION

The present invention generally relates to a coin actuation mechanism for vending machines and, more particularly, is concerned with a multi-coin operated actuation mechanism for a vending machine.

Products, such as gumballs and plastic capsules or balls containing candy or other novelties inside, are well-known and universally popular with consumers. Typically these products are sold in bulk vendors commonly referred to as vending machines. The vending machine basically includes a product reservoir, a coin-operated actuation mechanism, a dispensing mechanism and a product discharge structure. Historically, these four basic components of a vending machine were designed to cooperate in a single dispensing cycle, in response to insertion of a coin of predetermined denomination into a single slot, to serially transfer an item or items of product from the product reservoir down through the dispensing mechanism to an external discharge location via the product discharge structure. So, historically, the dispensing mechanism of the vending machine was designed to be actuated and controlled by insertion of only one coin into only one slot of a coin-operated actuation mechanism.

However, as the variety of product items sold in vending machines, the number of items sold per single dispensing cycle and the price of items all increased over time, modifications of coin-operated actuation mechanisms in various ways were undertaken to accommodate a need to increase the number of coins to operate the actuation mechanism. Representative prior art examples of modifications in various ways of accommodating increase in coins are disclosed in coin-operated actuation mechanism of U.S. Pat. No. 3,970,181 to Rubio, U.S. Pat. No. 4,350,239 to Tsuiki, U.S. Pat. No. 4,673,074 to McCormick, and U.K. Pat. Spec. No. 929,396 to Maxwell. In the actuation mechanisms of these examples, the use of a single slot is retained whereby all coins are fed into the coin-operated actuation mechanism through the same coin slot. Insertion of additional coins through the single slot is retained whereas either an increase in number of coin recesses is provided on a coin carrier wheel as in Rubio and McCormick or an increase in the width of the single coin recess on the coin carrier wheel is provided as in Tsuiki and Maxwell to accommodate one or more coins therein. These modifications often entail the necessity to make other extensive collateral changes to the actuation mechanism which adds to the complexity and cost of the modifications.

Other prior art examples of coin-operated actuation mechanisms using a pair of angularly-spaced coin insertion slots on the cover plate and a pair of angularly-spaced coin recesses on the coin carrier plate are disclosed in U.S. Pat. Nos. 5,657,848 and 5,924,542 to Schwarzli and U.S. Pat. No. 7,222,711 to Chang. One other coin-operated actuation mechanism known in the prior art employs several interchangeable coin carrier wheels each with a pair of angularly spaced coin recesses defined in the coin carrier wheel which align with a pair of angularly spaced coin insertion slots in the front plate. The pairs of coin recesses of the different interchangeable coin carrier wheels have different widths in order to accommodate different combinations of coins in them. The actuation mechanism also has a pair of coin diameter sensing dogs pivotally mounted to the front plate adjacent to coin carrier wheel and the circular path of travel of each of the recesses as the coin carrier wheel is rotated and thus aligned with the possible coin-receiving regions of the recesses. To accommodate the presence of different combinations of void and/or solid regions in defining the different widths of the recesses in the interchangeable coin carrier wheel for receipt of the different combinations of coins, the coin diameter sensing dogs of the actuation mechanism also need to be interchangeable, with some of the dogs having a working end so that when aligned with a void region in the coin recess of a given coin carrier wheel it will engage with a trailing edge of the recess in absence of a coin in the void region and block rotation of the carrier wheel or will engage with a coin in the recess and ride over the coin allowing the coin carrier wheel to continue its rotation. An alternate or different coin diameter sensing dog having a non-working end will be substituted for the just-described one with the working end and used in conjunction with a solid region of a substituted coin carrier wheel which is one that does not accept a coin. The non-working end of the dog will contact the solid region and ride over the same allowing the coin carrier wheel to continue rotation. Thus, time-consuming and tedious interchanges of both the coin carrier wheels and the coin diameter sensing dogs is envisioned to adapt the actuation mechanism to accommodate the use of different combinations of multiple coins.

Consequently, the aforementioned examples of the solutions of the prior art do not seem to provide an optimum solution for the problem at hand. Therefore, a need still remains for an innovation which will provide a solution to the aforementioned problem in the prior art without introducing any new problems in place thereof.

SUMMARY OF THE INVENTION

The present invention provides a multi-coin operated actuation mechanism designed to satisfy the aforementioned need. The multi-coin operated actuation mechanism of the present invention allows retention of the single coin insertion slot (although a pair of insertion slots could be utilized) by employment of a set of interchangeable coin carrier wheels. Each coin carrier wheel employs at least one coin recess and preferably two angularly-spaced coin recesses. But the coin recess(es) of one coin carrier wheel are adapted to accept a different number of multiple coins than the coin recess(es) of the other coin carrier wheel due to the fact that at least one of the recess(es) on one of the coin carrier wheel is of a different width from the other. Further, the multi-coin actuation mechanism employs only a standard or uniform set of coin sensing dogs for sensing whether the correct number of multiple coins have been inserted into the coin recess(es) of the coin carrier wheels with such sensing being independent of which coin carrier wheel is actually being employed at any given time, or, in other words, independent of the actual number of multiple coins carried by the coin carrier wheels. In other words, no change needs to be made to the standard or uniform set of coin sensing dogs to accommodate the interchange of the coin carrier wheels.

Accordingly, the present invention is directed to a multi-coin operated actuation mechanism for a vending machine which comprises: (a) a cover plate having a rear recessed cavity at a rear side thereof, with a central axis extending through the cavity, and at least a coin insertion slot defined through an upper portion of the cover plate and in communication with the cavity such that the coin insertion slot is disposed in spaced relation to and above the central axis; (b) a coin carrier wheel is disposed in the cavity of the cover plate to undergo rotation relative to the cover plate and about the central axis in a given direction, the coin carrier wheel including (I) a body having a peripheral edge and front and rear sides, (ii) at least one coin receiving recess defined into the rear side of the body so as to extend to and open at the peripheral edge thereof and be spaced from the axis such that the coin receiving recess is alignable with the coin insertion slot in the cover plate when the coin carrier wheel is disposed at a home position, the coin receiving recess having a predetermined width such that a set of a preselected number of multiple coins can be deposited through the coin insertion slot into coin accepting regions of the coin receiving recess when the coin carrier wheel is at the home position, and (iii) outer segments on the peripheral edge of the body disposed side-by-side to one another which each define either an abutment surface or a camming surface at an outer trailing end of the coin receiving recess being correspondingly aligned with either a coin accepting region of the recess or a coin non-accepting region of the recess adjacent to the accepting region; (c) a coin retainer plate attached to the cover plate and extending across the rear recessed cavity of the cover plate so as to be stationarily disposed adjacent to the rear side of the coin carrier wheel such that the coin retainer plate retains the set of multiple coins in the coin receiving recess of the coin carrier wheel as the coin carrier wheel is rotated from the home position to a discharge location; and (d) a coin diameter checking device including a set of multiple coin periphery sensing dogs pivotally mounted in a side-by-side position with respect to one another in the cavity of the cover plate with the dogs matching in number a maximum number of coins of the set of multiple coins, the coin dogs having respective outer tip surfaces substantially identical in configuration with one another and correspondingly aligned with and adapted to respectively engage the side-by-side outer segments on the peripheral edge of the body of the coin carrier wheel defining either the abutment surface or the camming surface at the outer trailing end of the coin receiving recess in the body of the coin carrier wheel, the coin dogs preventing the coin receiving recess to move past them in response to any of the multiple coins not being deposited into the coin accepting regions of the coin receiving recess by the coin dogs each being pivotal toward and away from the coin carrier wheel and into contact therewith, the outer tip surfaces of the coin dogs having like shapes functioning as cam followers adapting each of the coin dogs to make contact with and ride over one of the multiple coins when deposited in the coin receiving recess and thus not engage with the corresponding abutment surface at the trailing end of a coin accepting region of the coin receiving recess of the coin carrier wheel or to make contact with and ride over the corresponding camming surface at the trailing end of a coin non-accepting region of the coin receiving recess of the coin carrier wheel adjacent to a coin accepting region. The coin carrier wheel is one of a pair of coin carrier wheels which can be used interchangeably with one another when it is desired to change the number of coins to be deposited into the actuation mechanism to operate the vending machine. Of the pair of one and the other of coin carrier wheels, one will have the coin receiving recess of a different width than the coin receiving recess of the other due to the coin receiving recess of the one being formed with fewer coin accepting regions than the other and with a camming surface at the outer segment on the peripheral edge of the one aligned with the coin non-accepting region of the recess of the one rather than an abutment surface at the outer trailing end of the coin receiving recess of the other. Additionally, the coin diameter sensing device includes a housing removably mounted to the cover plate at least partially within the rear recessed cavity therein and adjacent to the coin carrier wheel, the set of multiple coin periphery sensing dogs pivotally mounted in a side-by-side position with respect to one another in the housing such that the dogs together with the housing constitute a unit removably mounted to the cover plate.

Further, the actuation mechanism includes a detent mounted to the cover plate adjacent to the coin carrier wheel and within the rear recessed cavity and angularly displaced from the set of multiple coin dogs and being adapted to engage the coin carrier wheel at the abutments of the coin accepting regions of the coin receiving recess and halt further movement of the coin carrier wheel should operation of the coin dogs be circumvented by an unauthorized act.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
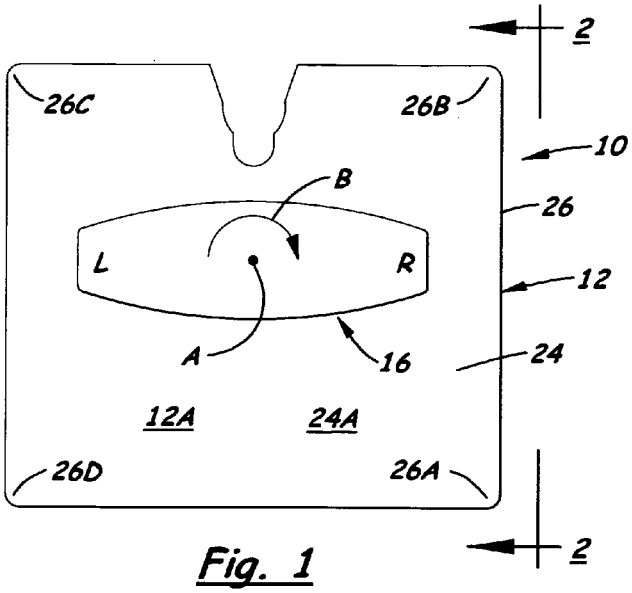
FIG. 1 is a front elevational view of a multi-coin operated actuation mechanism incorporating the features (not shown) of the present invention, with a turning handle of the actuation mechanism being shown in an initial position.

Referring to the drawings and particularly to FIGS. 1 to 9, there is illustrated a multi-coin operated actuation mechanism 10 employing features of the present invention. The actuation mechanism 10 is designed for use in a conventional vending machine (not shown). Basically, the actuation mechanism 10 includes a face or cover plate 12, a central shaft 14, a transverse handle 16, a coin carrier wheel 18, a coin retainer backplate 20, and a ratchet device 22. In a known manner, the actuation mechanism 10 via its cover plate 12 mounts in a slot formed in a front wall of a housing of the vending machine, and the central shaft 14 extends through the cover plate 12 between the exterior and interior of the vending machine housing. In such arrangement, a front side 12A of the cover plate 12 with the transverse handle 16 on the central shaft 14 are disposed at the exterior of the vending machine housing, whereas a rear side 12B of the cover plate 12 with the coin carrier wheel 18 and the ratchet device 22 on the central shaft 14 and the coin retainer backplate 20 on the cover plate 12 are disposed at the interior of the vending machine housing.

Referring now to FIGS. 1 to 4, the cover plate 12 of the actuation mechanism 10 has a central body 24 with front and rear faces 24A, 24B respectively at the front and rear sides 12A, 12B of the cover plate 12 and an outer flange 26 rigidly attached to and extending about a periphery of the central body 24. The outer flange 26 also projects a short distance rearwardly from the rear face 24B of the central body 24 such that the central body 24 and the outer flange 26 together form a rear recessed cavity 28 at the rear side 12B of the cover plate 12. Also, the central body 24 of the cover plate 12 has a central opening 30 defined therein so as to extend between its front and rear faces 24A, 24B and about an axis A of the central body 24. The cover plate 12 further has at least one coin insertion slot 32 defined through an upper portion of the outer flange 26 and partially into the central body 24 and in communication with the cavity 28 such that the slot 32 is disposed in spaced relation to and above the axis A of the cover plate 12. The coin insertion slot 32 is for receiving a set of multiple coins C, such as three US quarters (25-cent pieces) in the illustrated embodiment of the actuation mechanism 10.

The central shaft 14 of the actuation mechanism 10 extends from a front end 14A, disposed outwardly from the front face 24A of its central body 24, through the central opening 30 in the central body 24 and through the rear recessed cavity 28, to a rear end 14B disposed rearwardly of the rear recessed cavity 28 at the rear side 12B of the cover plate 12. The central shaft 14 is rotatably mounted to the central body 24 of the cover plate 12 through the central opening 30 and extends coaxially along the axis A of the cover plate 12. The transverse handle 16 is fixedly attached or fastened to the front end 14A of the central shaft 14, disposed adjacent to the front face 24A of the central body 24 of the cover plate 12, such that the handle 16 may be turned by a user to rotate the central shaft 14 about the axis A in a given direction, such as clockwise, as indicated by an arrow B in FIG. 1.

Figure 9:
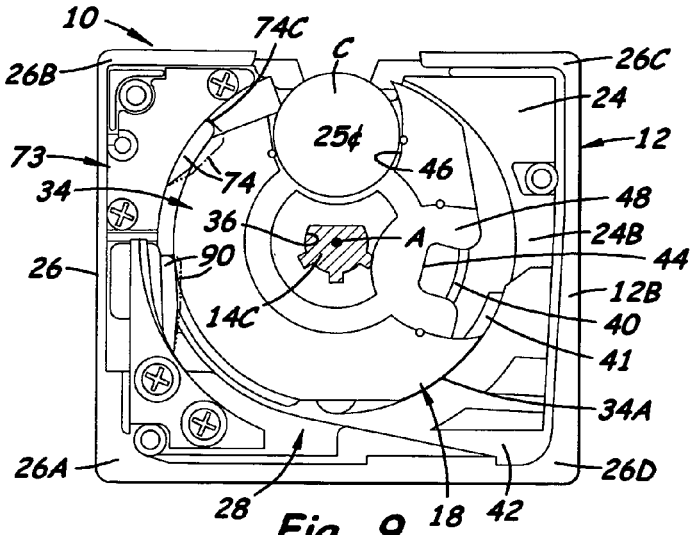
FIG. 9 is a rear elevational view of the actuation mechanism similar to that of FIG. 3 but with a ratchet device and coin retainer backplate of the actuation mechanism removed to show the coin carrier wheel of FIG. 5 disposed at a starting or home position with a first of a pair of coin receiving recesses on the rear side of the coin carrier wheel aligned with a coin slot in the top of the cover plate of the actuation mechanism and a first set of coins inserted through the coin slot and disposed in the first coin receiving recess.
Figure 10:
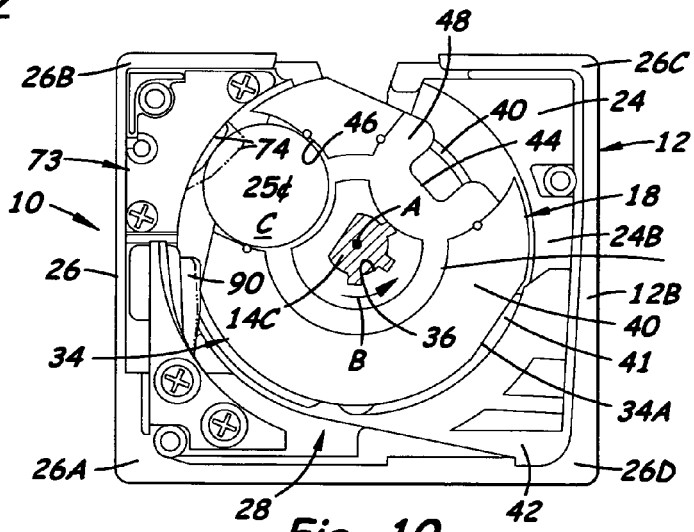
FIG. 10 is a rear elevational view of the actuation mechanism similar to that of FIG. 9, but now showing the coin carrier wheel rotated counterclockwise about forty-five degrees from its home position in FIG. 9 to a first intermediate position such that the first set of coins have engaged and displaced a set of coin sensing dogs which constitute one of the elements of the present invention incorporated by the actuation mechanism.
Figure 11:
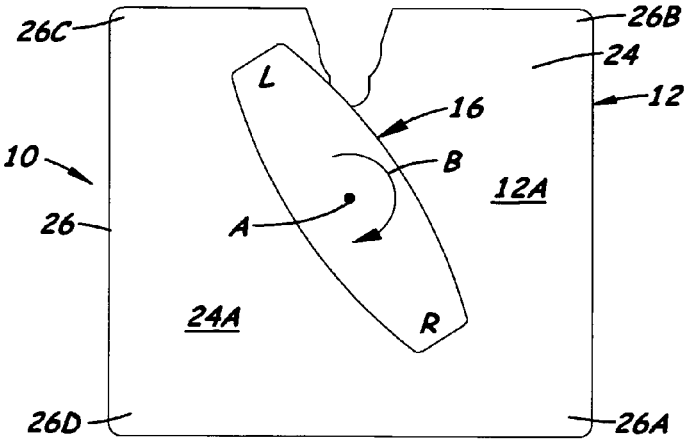
FIG. 11 is a front elevational view of the actuation mechanism similar to that of FIG. 1 but now showing the handle after being turned clockwise about forty-five degrees from its initial position in FIG. 1 which caused the counterclockwise rotation of the coin carrier wheel to the position of FIG. 10.

Referring to FIGS. 5 to 8, there is shown a first of a pair of coin carrier wheels 18 that can be interchangeably employed in the actuation mechanism 10. The coin carrier wheel 18 has a substantially circular body 34 with a central hole 36, a peripheral edge portion 34A, and front and rear sides 34B, 34C. The central hole 36 of the circular body 34 is defined by a flat base 36A and a plurality of grooves 36B spaced apart by a plurality of slightly curved segments 36C which provide a set of features adapting the coin carrier wheel 18 to fit on and mount over an axial segment 14C of the central shaft 14 having a set of features complementary thereto as seen in FIG. 9, namely a flat surface 14D and a plurality of splines 14E spaced apart by a plurality of slightly curved surfaces 14F. In such manner, the coin carrier wheel 18 is disposed in the rear recessed cavity 30 of the cover plate 12 to undergo rotation with the central shaft 14, which is counterclockwise as viewed in FIG. 9, upon turning of the handle 16 relative to the cover plate 12 and about the axis A in the given direction B, which is clockwise as viewed in FIG. 1. When the coin carrier wheel 18 is so mounted over the axial segment 14C of the central shaft 14, a front portion 34D at the front side 34B of the circular body 34 is defined and surrounded by a middle portion 34E of the circular body 34 so as to define a recess 37 about the periphery of the front portion 34D at the front side 34B of the circular body 34 such that the front portion 34D will seat within a central space 38 bounded by a circular guide rail 40 formed on the rear face 24B of the central body 24 of the cover plate 12. Thus, the coin carrier wheel 18 only at its middle portion 34E, adjacent to the periphery of its front portion 34D, will overlap and make frictional contact with the cover plate 12 at the circular guide rail 40 during rotation of the coin carrier wheel 18 relative to the cover plate 12 in the rear recessed cavity 28 at the rear side 12B of the cover plate 12. The middle portion 34E of the circular body 34 is defined and surrounded by a rear portion 34F at the rear side 34C of the circular body 34 so as to form a recess 39 about the periphery of the middle portion 34E at the front side 34B of the central body 34 such that only the rear portion 34F will overlap a curved guide rail 41 on the cover plate 12 adjacent to a coin discharge location 42 defined on the cover plate 12.

Figure 13:
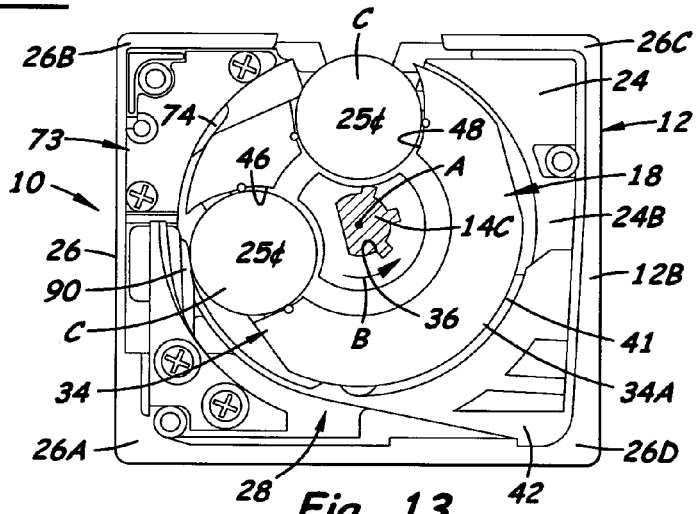
FIG. 13 is a rear elevational view of the actuation mechanism similar to that of FIG. 10 but now showing the coin carrier wheel rotated counterclockwise about ninety degrees from the initial position of FIG. 9 to a second intermediate position such that the first set of coins now engage and displace a backup dog and a second of the pair of coin receiving recesses on the coin carrier wheel is aligned with the coin slot and a second set of coins have been inserted through the coin slot and disposed in the second coin receiving recess.
Figure 14:
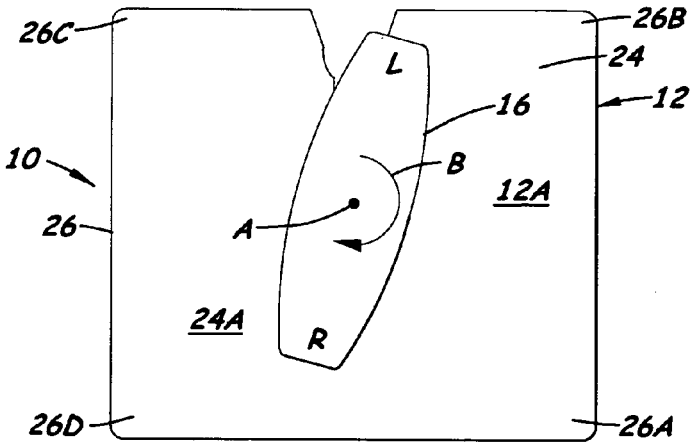
FIG. 14 is a front elevational view of the actuation mechanism similar to that of FIG. 11 but now showing the handle after being turned clockwise about ninety degrees from its initial position in FIG. 1 and forty-five degrees from its position shown in FIG. 11 which caused the counterclockwise rotation of the coin carrier wheel to the position of FIG. 13.
Figure 15:
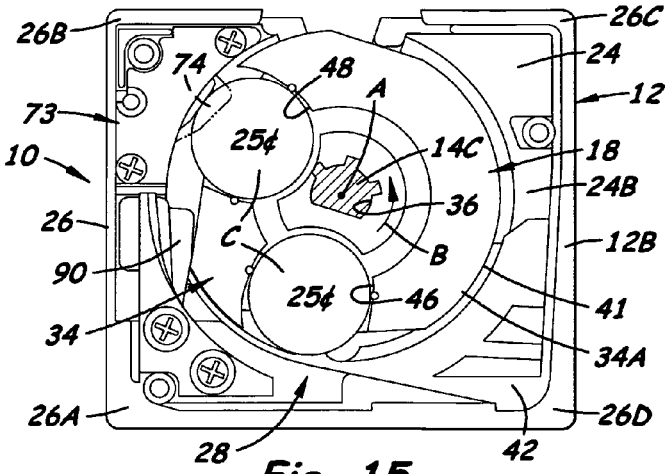
FIGS. 15 to 18 are alternately rear and front elevational view of the actuation mechanism correspondingly similar to those of FIGS. 13 and 14 but now showing the coin carrier wheel and handle at successive intermediate positions so as to deliver the coins to a discharge location.
Figure 16:
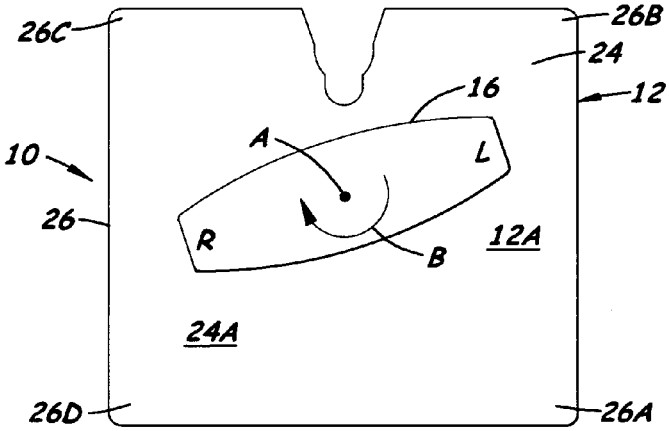
Figure 22:
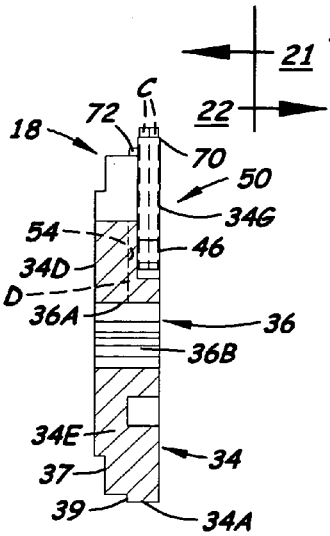
FIG. 22 is another vertical cross-sectional view of the second coin carrier wheel taken along line 22-22 of FIGS. 19 and 20.
Figure 23:
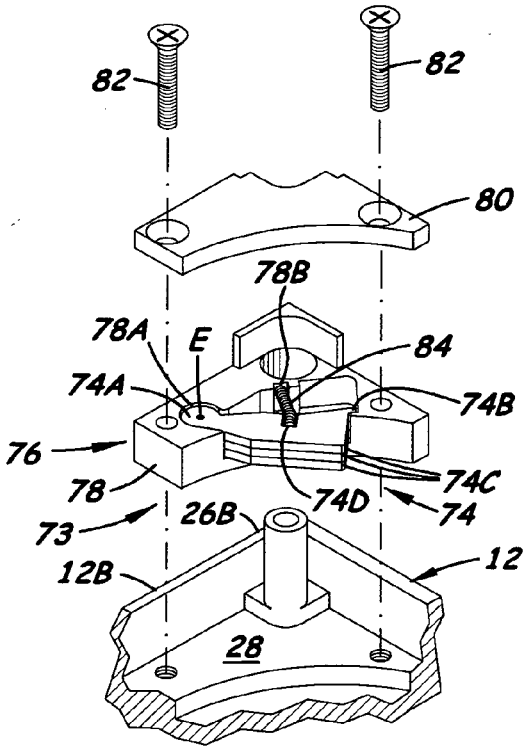
FIG. 23 is an enlarged exploded view of a coin diameter checking device constituting still another of the features of the present invention shown together with a fragmentary portion of the cover plate on which the device will be mounted.
Figure 24:
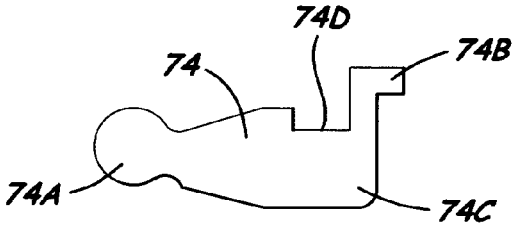
FIG. 24 is an enlarged side elevational view of one of the coin periphery sensing dogs of the checking device.
Figure 25:
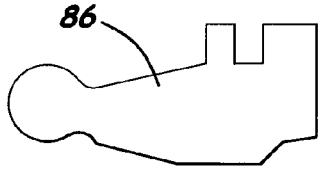
FIG. 25 is an enlarged side elevational view of one of the spacers of the checking device.
Figure 26:
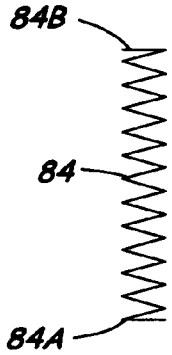
FIG. 26 is an enlarged side elevational view of one of the coin springs of the checking device.

The coin carrier wheel 18 also has first and second notches 43, 44 defined into the front and middle portions 34D, 34E of the circular body 34 so as to extend to and open at the peripheral edge portion 34A thereof and match the profile of the slot 32 in the cover plate 12, and further has first and second coin receiving recesses 46, 48 defined into the rear portion 34F of the circular body 34 so as to extend to and open at the peripheral edge portion 34A thereof. The notches 43, 44 are aligned with the recesses 46, 48 and facilitate the depositing of coins C into the recesses 46, 48. Also, the segments of the middle portion 34E forming the first and second notches 43, 44 define front walls for the first and second coin receiving recesses 46, 48 for holding the coins C therein. The first notch 43 and first recess 46 are located side-by-side and angularly spaced about ninety degrees from the second notch 44 and second recess 48 about the axis A of the central body 24 of the cover plate 12. At a leading home position of the coin carrier wheel 18 as seen in FIG. 9, the first notch 43 and first recess 46 are aligned with the coin insertion slot 32 in the cover plate 12. After rotation of the coin carrier wheel 28 and the central shaft 14 by turning the handle 16 in the given direction B to a trailing position as seen in FIG. 13, the second notch 44 and second recess 48 become aligned with the coin insertion slot 32 in the cover plate 12. The first and second coin receiving recesses 46, 48 have predetermined widths such that a first set of a preselected number of multiple coins C, such as three in number, can be deposited through the coin insertion slot 32 into the multiple coin accepting regions 50 of the first coin receiving recess 44 when the coin carrier wheel 18 is at the leading first position and a second set of preselected number of multiple coins C can be deposited through the coin insertion slot 32 into multiple coin accepting regions 52 of the second coin receiving recess 48 when the coin carrier wheel 18 is at the trailing position. In the case of the use of another combination of multiple coins C, a second of the pair of coin carrier wheels 18, such as seen in FIGS. 19 to 22, can be interchanged for the first coin carrier wheel seen in FIGS. 5 to 8. As seen in FIG. 22, the second coin carrier wheel 18 has a coin non-accepting region 54 being separated by dashed line D from the middle portion 34E of the central body 34, adjacent to one or the other or both of the first and second multiple coin accepting regions 50, 52. As an alternative to the one coin insertion slot 32, the cover plate 12 could have two such slots angularly displaced from one another, for example, by the same distance as the first and second coin receiving recesses 46, 48, although the use of one coin insertion slot 32 is preferred.

Figure 2:
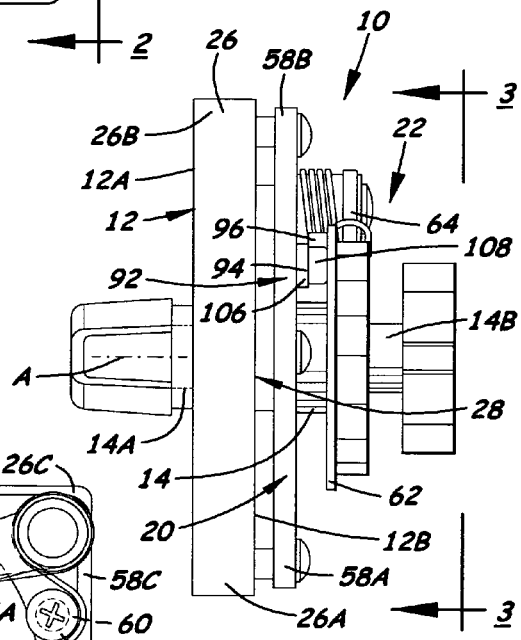
FIG. 2 is a side elevational view of the actuation mechanism as seen along line 2-2 of FIG. 1
Figure 3:
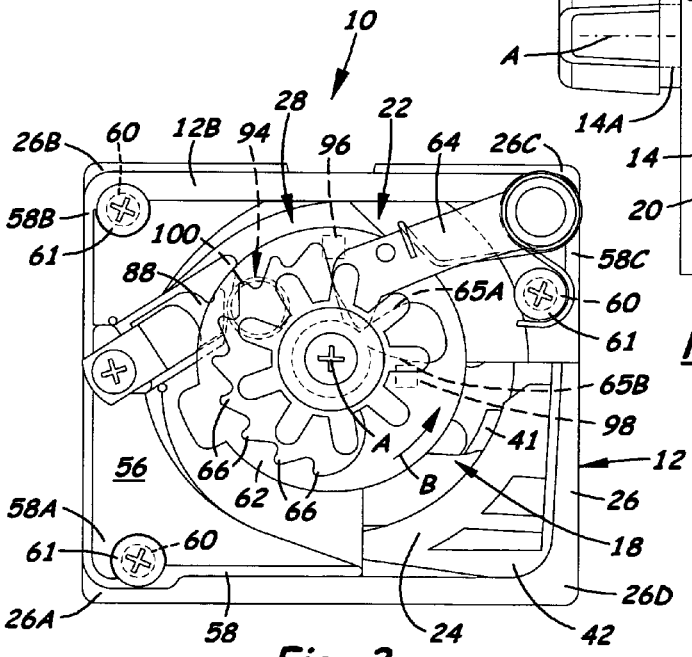
FIG. 3 is a rear elevational view of the actuation mechanism as seen along line 3-3 of FIG. 2.
Figure 4:
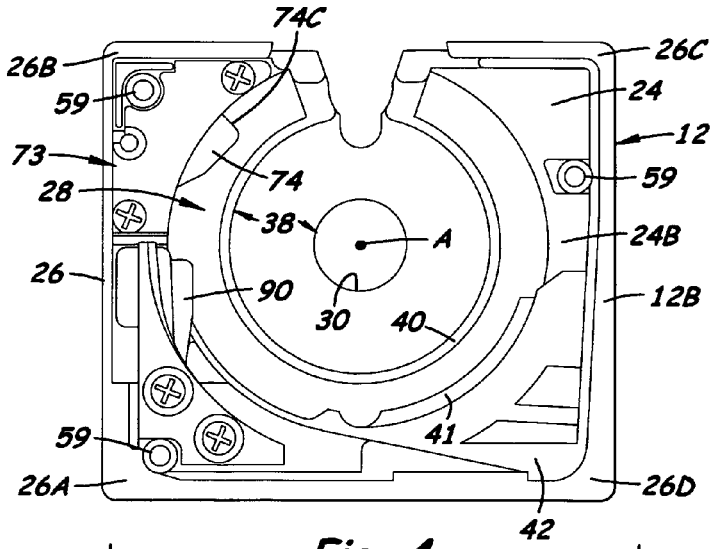
FIG. 4 is a rear elevational view of a face or cover plate of the actuation mechanism of FIG. 3.
Figure 5:
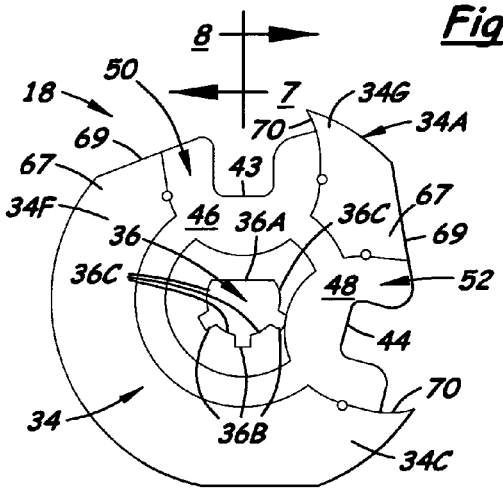
FIG. 5 is a rear elevational view of a first of a pair of interchangeable coin carrier wheels constituting one of the features of the present invention used in the actuation mechanism of FIG. 3.
Figure 6:
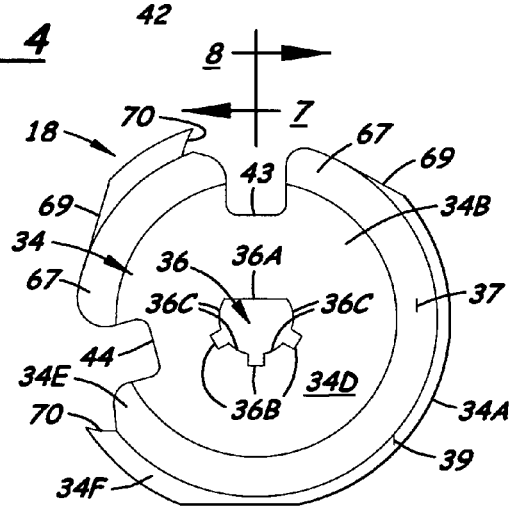
FIG. 6 is a front elevational view of the first coin carrier wheel of FIG. 5.
Figure 7:
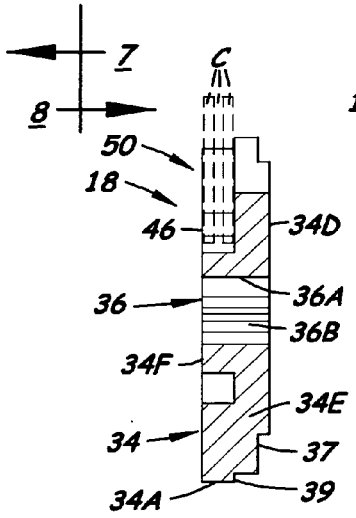
FIG. 7 is a vertical cross-sectional view of the first coin carrier wheel taken along line 7-7 of FIGS. 5 and 6.
Figure 8:
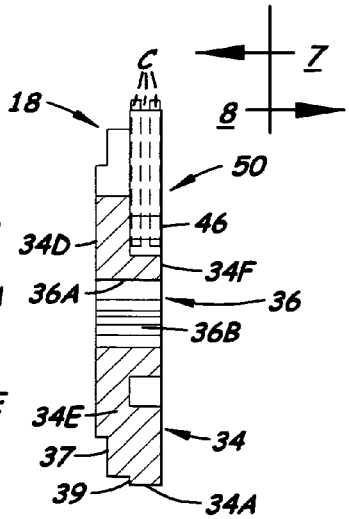
FIG. 8 is another vertical cross-sectional view of the first coin carrier wheel taken along line 8-8 of FIGS. 5 and 6.
Figure 17:
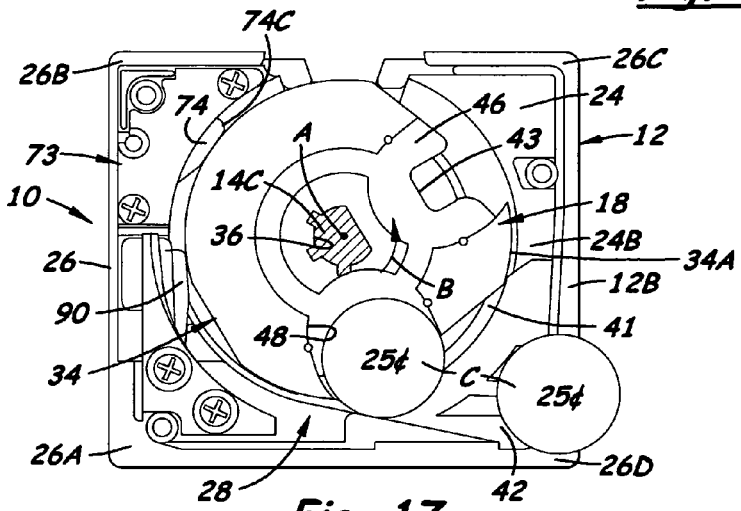
Figure 18:
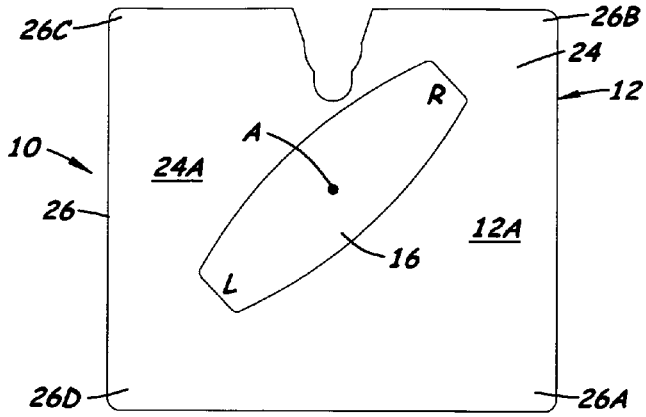
Figure 19:
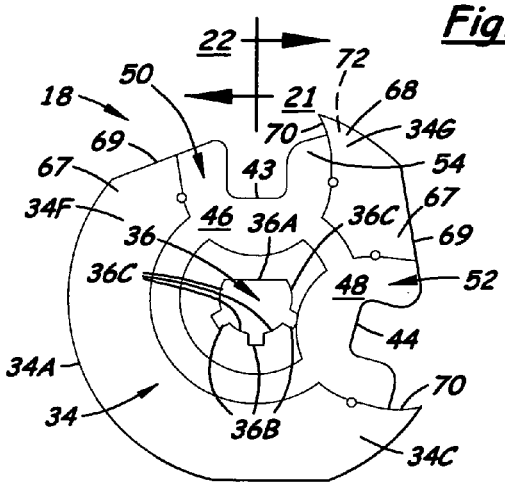
FIG. 19 is a rear elevational view of a second of a pair of interchangeable coin carrier wheels constituting another of the features of the present invention used in the actuation mechanism of FIG. 3.
Figure 20:
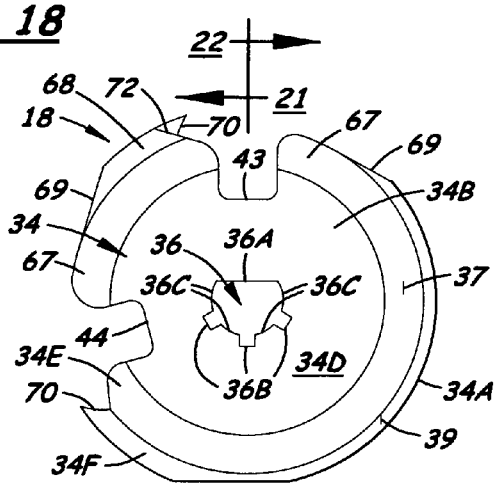
FIG. 20 is a front elevational view of the second coin carrier wheel of FIG. 19.
Figure 21:
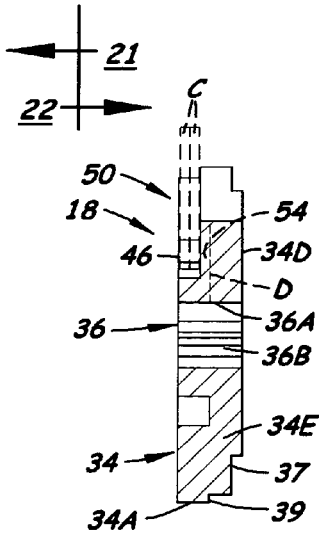
FIG. 21 is a vertical cross-sectional view of the second coin carrier wheel taken along line 21-21 of FIGS. 19 and 20.

As seen in FIGS. 2 and 3, the coin retainer backplate 20 of the actuation mechanism 10 has a central portion 56 connected to and partially surrounded by a peripheral portion 58 by which the coin retainer backplate 20 is attached to the cover plate 12 at its rear side 12B. A plurality of threaded holes 59 are defined in three of the corner locations 26A, 26B, 26C of the outer flange 26 of the cover plate 12 which are alignable with a plurality of holes 60 defined in three of the corners 58A, 58B, 58C of peripheral portion 58 of the backplate 20 for attaching the backplate 20 to the cover plate 12 by a plurality of screws 61. The central portion 56 of the backplate 20 extends across the rear recessed cavity 28 of the cover plate 12 so as to be stationarily disposed closely adjacent to the rear side 34C of the circular body 34 of the coin carrier wheel 18 such that the central portion 56 of the backplate 20 defines a rear wall to the first and second coin receiving recesses 46, 48 of the coin carrier wheel 18 which retains the first and second sets of multiple coins C in the first and second coin receiving recesses 46, 48 as the coin carrier wheel 18 is rotated with the central shaft 14, by turning the handle 16, from its initial position through several intermediate positions to the discharge location 42, as shown in FIGS. 9 to 18. Specifically, in FIGS. 13 to 18 there is shown examples of successive intermediate positions through which the coin carrier wheel 18 is rotated and also positions through which the handle 16 is turned to rotate the central shaft 14 upon which both the handle 16 and the coin carrier wheel 18 are mounted for rotation therewith. These positions are felt to be self-explanatory and thus need not be described further. The ultimate objective, by the turning of the handle 16 and the rotation of the coin carrier wheel 18, is the delivery of both sets of coins to the coin discharge location 42 on the cover plate 12 of the actuation mechanism 10 at the corner location 26D, as shown in FIG. 17.

Referring again to FIGS. 2 and 3, the ratchet device 22 of the actuation mechanism 10 includes a ratchet gear wheel 62 fixedly mounted to the rear end 14B of the central shaft 14 for undergoing rotation therewith. The ratchet device 22 also includes a spring-loaded pawl 64 pivotally mounted to the backplate 20 adjacent to the ratchet gear wheel 62. The pawl 64 is positioned to engage in a pair of successive notches 65A, 65B and a series of successive teeth 66 defined about the ratchet gear wheel 62 such that the central shaft 14, ratchet gear wheel 62 and coin carrier wheel 18 can only be rotated in the given direction B once that the central shaft 14 has rotated sufficiently to bring the pawl 64 into engagement with the second notch 65B on the ratchet gear wheel 62. Once the pawl 64 is at the position of notch 65B, and the coin carrier wheel 18 and handle 16 are thus at the respective positions seen in FIGS. 13 and 14, then the spring-loaded pawl 64 of the ratchet device 22 prevents reverse rotation of the central shaft 14, ratchet gear wheel 62 and coin carrier wheel 18.

In accordance with the features of the present invention, as seen in FIGS. 5 to 8 and 19 to 22, the coin carrier wheel 18 further includes respective outer segments 67, 68 provided at the peripheral edge portion 34A of the circular body 34 of the coin carrier wheel 18 adjacent to opposite outer leading and trailing ends of the first and second coin receiving recesses 46, 48 thereon in the given direction B of rotation of the coin carrier wheel 18 with the central shaft 14. Each outer segment 67 defines a cutaway or relief surface 69 at the outer leading end of each of the first and second coin receiving recesses 46, 48 and each outer segment 68 defines either only an abutment surface 70 at the outer trailing end of each of the first and second coin accepting regions 50, 52 of the first and second coin receiving recesses 46, 48 or the aforesaid abutment surface 70 together with an inclined camming surface 72 at the outer trailing end of each coin non-accepting region 54 adjacent to a corresponding one of the coin accepting regions 50, 52 of a given one of the first or second coin receiving recesses 46, 48.

In accordance with the features of the present invention, first and second coin carrier wheels 18 of an interchangeable pair thereof are shown respectively in FIGS. 5 to 8 and 19 to 22. The first coin carrier wheel 18 shown in FIGS. 5-8 has first and second coin receiving recesses 46, 48 designed to hold 3 coins C each, namely US quarters or 25-cent pieces, as shown in dashed outline form in FIGS. 7 and 8. The second coin carrier wheel 18 shown in FIGS. 19 to 22 has first and second coin receiving recesses 46, 48 designed to hold two coins and three coins, respectively, which again are US quarters or 25-cent pieces. With respect to the second coin carrier wheel 18, in accordance with the features of the present invention, a coin non-accepting region 54 is present in conjunction with the coin accepting regions 50 and has a camming surface 72 thereon at its outer segment 68. It can be readily observed that, of the relief, abutment and camming surfaces 69, 70, 72, the abutment surface 70 is displaced the greatest distance from the central axis A, the relief surface 69 is displaced the smallest distance from the central axis A, and points along the inclined camming surface 72 are displaced an intermediate distance from the central axis A between the greatest and smallest distances.

Referring now to FIGS. 3, 4 and 23 to 26, also in accordance with the features of the present invention, the actuation mechanism 10 further includes a coin diameter checking device 73 which includes a set of multiple side-by-side coin periphery sensing dogs 74 which, matching in number the maximum number of coins of the first and second sets of multiple coins, such being three coins in the example of FIGS. 5 to 8, are for checking whether or not the coins C are of the correct diameter. These dogs 74 are mounted as a unit in a housing 76 comprised of a base 78 and a cover 80 which are fastened by screws 82 to the cover plate 12 adjacent to the outer flange 26, proximate the one corner location 20B, and within the rear recessed cavity 28 and adjacent to the coin carrier wheel 18. More particularly, at their first ends 74A the coin periphery sensing dogs 74 are circular shaped and fitted into a cylindrical cavity 78A defined in the housing base 78 for undergoing pivotal movement toward and away from the peripheral edge portion 34A of the circular body 34 of the coin carrier wheel 18 and about an axis E spaced from and extending parallel to the axis A. The coin periphery sensing dogs 74 also have respective opposite second ends 74B with outer tip surfaces 74C which are substantially identical in configuration with one another and correspondingly are aligned with and adapted to respectively engage the side-by-side outer segments 68 on the peripheral edge 34A of the circular body 34 of the coin carrier wheel 18 defining either the abutment surface 70 or the camming surface 72 at the outer trailing end of each of the first and second coin receiving recesses 46, 48 in the respective coin carrier wheels 18. Between their opposite first and second ends 74A, 74B, the coin periphery sensing dogs 74 have notches 74D which each respectfully receives a coil spring 84 at one end 84A thereof which is seated at its opposite end 84B in a recess 78D in the housing base 78. Also between each of the adjacent pairs of coin dogs 74 is disposed a thin spacer 86 being mounted at one end to the cavity 78A of the housing base 78 in a manner similar to the mounting of the coin periphery sensing dogs 74. The spacers 86 function to confine the coin springs 84 in place and prevent interference with movement of neighboring coin periphery sensing dogs 74. Thus, the coin periphery sensing dogs 74 are individually and separately pivotally movable toward and away from the coin carrier wheel 18 and are biased by the coil springs 84 to pivot toward the coin carrier wheel 18 and into contact therewith at the outer tip surfaces 74C of the second ends 74B of the coin periphery sensing dogs 74. The outer tip surfaces 74C have like shapes functioning as cam followers adapting each of the coin periphery sensing dogs 74 to ride over one of the multiple coins C when deposited in one of the first and second coin receiving recesses 46, 48 and thus not engage with the corresponding abutment surface 70 at the trailing end of a coin accepting region 50, 52 of one of the first and second coin receiving recesses 46, 48 of the coin carrier wheel 18 when the latter moves from an initial position as seen in FIG. 9 to a first intermediate position seen in FIG. 10 upon turning of the handle 16 in the given direction B from the initial position seen in FIG. 1 to the angularly displaced clockwise position seen in FIG. 11. Also, the shape of the outer tip surfaces 74C of the second ends 74B of the coin periphery sensing dogs 74 still functioning as cam followers would adapt each of the coin periphery sensing dogs 74 to make contact with and ride over the corresponding camming surface 72 at the trailing end of the coin non-accepting region 54 adjacent the first coin accepting region 50 as seen in FIGS. 19 to 22.

Figure 12:
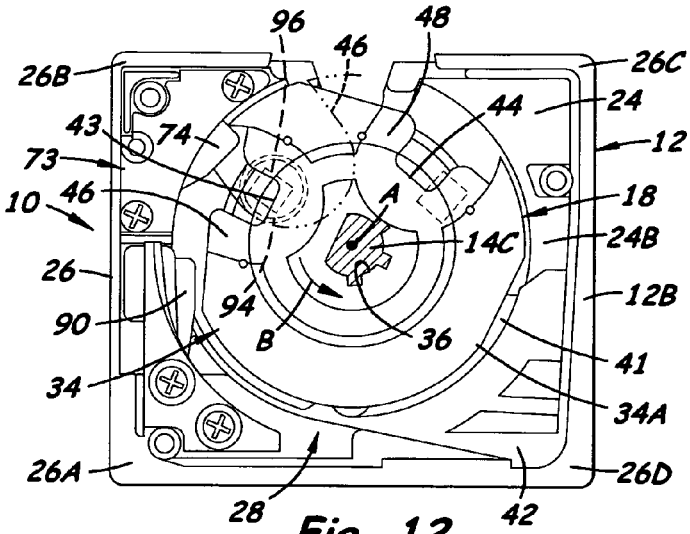
FIG. 12 is a rear elevational view of the actuation mechanism similar to that of FIG. 10 but now showing the coin carrier wheel, without coins inserted into the first coin receiving recess, rotated counterclockwise about fifteen degrees farther from its position in FIG. 10 such that now the set of coin sensing dogs have sensed the absence of the coins and engaged an edge of the coin carrier wheel defining a trailing portion of the first coin receiving recess and blocked further rotation of the coin carrier wheel.

However, as shown in FIG. 12, the coin periphery sensing dogs 74 will prevent movement of the coin carrier wheel 18 and the coin receiving recesses 46, 48 thereon past the coin periphery sensing dogs 74 through contact with the corresponding abutment surfaces 70 on the outer segments 68 in response to any of first and second sets of multiple coins not being deposited into the coin accepting regions 50, 52 of the first and second coin receiving recesses 46, 48. In accordance with the features of the present invention, the relief surfaces 69 being at a lesser distance from the central axis A reduce the magnitude of the force that needs to be applied against the dogs 74 by the coin carrier wheel 18, by allowing the dogs 74 to extend further toward the coin carrier wheel 18, during the rotation of the wheel 18 about the portion of each dispensing cycle leading up to when the coin receiving recesses 46, 48 are aligned with the dogs 74 and the coins therein engage the dogs 74 and force them to ride over the coins. Thus, the relief surfaces 69 allow smoother or easier exertion, and one requiring less strength, for turning the handle 16 and rotating the coin carrier wheel 18.

In according to conventional practice, the actuation mechanism 10 also includes a coin thickness sensing dog 88 mounted to the coin retainer backplate 20 and extending to contact with the front portion 34D of the circular body 34 of the coin carrier wheel 18 downstream from the first coin receiving recess 46. The coin thickness sensing dog 88 is adapted to contact the face of a coin to check the thickness of the coins C deposited in the recesses 46, 48 and will engage the trailing edge of the recesses 46, 48 if the coins are below the required thickness.

Further, in accordance with the features of the present invention, the actuation mechanism 10 includes a backup detent such as in the form of another coin periphery sensing dog 90, pivotally mounted to the cover plate 12 adjacent to the outer flange 26 thereof and within the rear recessed cavity 28 and angularly displaced downstream from the set of multiple coin periphery sensing dogs 74 and one coin thickness sensing dog 88. The backup dog 90 functions to engage the coin carrier wheel 18 at the abutment surfaces 70 of the coin accepting regions 50, 52 of the first and second coin-receiving recesses 46, 48 and halt further movement of the coin carrier wheel 18 in the given direction B should the operation of the coin dogs 74, 88 be circumvented by an unauthorized act such as insertion of a stiff drinking straw between the periphery of the coin carrier wheel 18 and the coin dogs 74, 88. Such unauthorized act would prevent the coin dog 88 from entering the coin-receiving recesses 46, 48 and prevent the outer tip surfaces 74C of the coin dogs 74 from engaging the abutment surfaces 70 of the coin receiving recesses 46, 48 when coins are absent therefrom. Although the use of the backup dog 90 will generally serve to prevent such acts of vandalism as just described, unfortunately when the coin carrier wheel 18 has rotated sufficiently to bring either one of its coin receiving recesses 46, 48 into proximity of the backup dog 90, the ratchet wheel 62 also has rotated sufficiently to cause the pawl 64 to pass the first notch 65A and at least enter the second notch 65B such that is it is impossible to reverse rotate the coin carrier wheel 18 in the direction opposite to the given direction B to return either of its coin receiving recesses 46, 48 to the positions of FIG. 9 or 13 in which either of them are aligned with the coin insertion slot 32. Although the coin carrier wheel 18 is prevented from being rotated through a full dispensing cycle such that an item will be dispensed without the collection of coins in payment therefore, the vending machine is rendered inoperative until the operator can service the machine so as to return it to working condition. During the interim, unfortunately the vending machine cannot dispense any items nor earn any revenue for its owner.

Turning now to FIGS. 2, 3, 12 and 27-29, there is illustrated an anti-vandalism device (AVD), generally designated 92, constituting the features of the invention of the patent application cross-referenced above and thus not forming part of the present invention. The AVD 92 will overcome the problem just described by obviating the need, or making it unnecessary, to rely on the backup dog 90 to prevent such vandalism of the actuation mechanism 10 of the vending machine and the resulting theft of items from the vending machine by shutting down the vending machine from further normal working operation. As will become clear hereinafter, the AVD 92 stops rotation of the coin carrier wheel 18 prior to it reaching the point where reversal of its rotation back to the initial position is not possible by merely reversal of the direction in which the handle 16 is turned. While the AVD 92 is illustrated as applied to the actuation mechanism 10 described above which has either of the coin carrier wheels 18 with first and second coin receiving recesses 46, 48 being each designed for receiving multiple coins C, it should be understood that the AVD 92 is equally applicable to an actuation mechanism, not incorporating the above-described configuration and features of the actuation mechanism 10 of the present invention, which has a more basic or simple receiving recess for receiving a single coin and with a single coin periphery sensing dog and a single coin thickness sensing dog for ensuring the deposit of the correct coin into the recess. This basic actuation mechanism construction is well-known in the prior art. Thus, hereinafter for the purpose of simplifying the description without sacrificing any understanding of the scope and breadth of the advantages of the AVD 92 as a comprehensive solution to the type of vandalism mentioned above, the operation of the AVD 92 will be described in relation to just the first coin receiving recess 46 of the coin carrier wheel 18 in view that such operation would merely be repeated with respect to the second coin receiving recess 48 of the coin carrier wheel 18.

Figure 27:
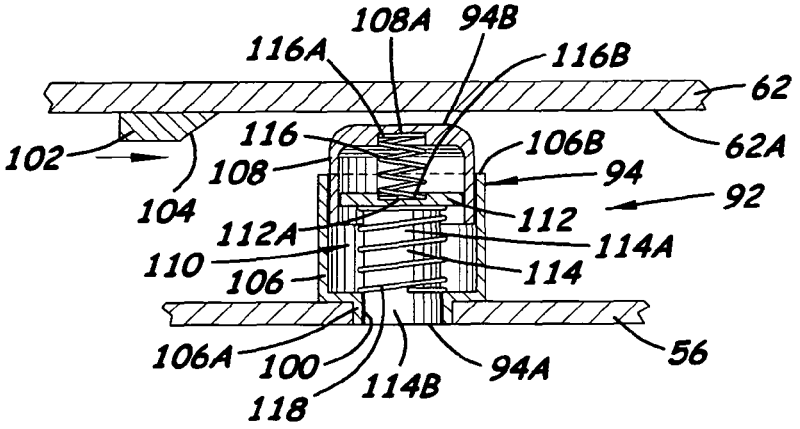
FIG. 27 is an enlarged cross-sectional view of an anti-vandalism device incorporated by the actuation mechanism and constituting the invention of the above cross-reference patent application, showing the anti-vandalism device in an initial or starting position.
Figure 28:
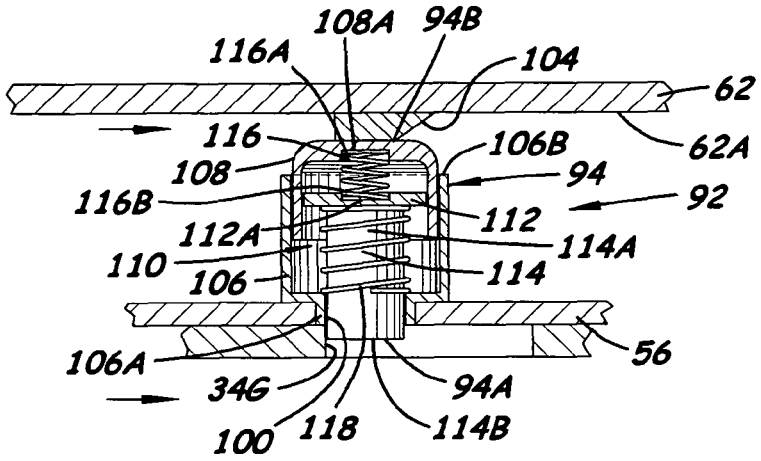
FIG. 28 is another enlarged cross-sectional view of the anti-vandalism device now showing it blocking movement of the coin carrier wheel when less than the required number of coins are present in the coin receiving recess of the coin carrier wheel.

Basically, the AVD 92 includes a stop 94 and an actuator 96. A second actuator 98 is shown in FIGS. 3 and 12 which is involved in a repeat of the blocking operation performed by the AVD 92 in conjunction with the second coin receiving recess 48 and so it will not be discussed further hereinafter. The stop 94 has a front end 94A and a rear end 94B and a construction which, as will be explained in detail later, permits it to be movably extendible and compressible in length. The stop 94 is mounted on the rear side 56A of the central portion 56 of the coin retainer backplate 20 so as to allow it to transition between a non-blocking state or condition, as seen in FIG. 27, and a blocking state or condition, as seen in FIG. 28. In the non-blocking condition of FIG. 27, which is the normal "at rest" state or condition of the AVD 92, the stop 94 is at its extended length with its front end 94A in a retracted position "at rest" in a bore 100 defined in the coin retainer backplate 20. As seen in FIG. 3, the bore 100 and thus the stop 94 are located only a very short distance upstream from the leading end of the coin thickness sensing dog 88 and inwardly from and adjacent to the coin periphery sensing dogs 74. In such retracted position, the front end 94A of the stop 94 is located out of the path of the coin carrier wheel 18 so as not to block its rotation in the given direction B. In FIG. 12, when the first coin receiving recess 46 is at the dashed line position the stop 94 of the AVD 92 is in its normal "at rest" condition with its front end 94A in the retracted position. In such retracted position, the front end 94A of the stop 94 is not within the span of vision of a person attempting to look through any narrow gap 95 remaining at the left end of the coin insertion slot 32. Thus, the AVD 92 is effectively invisible to anyone attempting to figure out why the insertion of a straw between the periphery of the coin carrier wheel 18 and the coin periphery dog 74 (instead of a coin or coins in the slot 32) will no longer allow turning of the handle 16 and rotation of the coin carrier wheel 18 perhaps more than an initial forty degrees through one complete cycle of operation. In the blocking condition of FIG. 28, the front end 94A of the stop 94 projects from and beyond the bore 100 in the coin retainer backplate 20 into the coin receiving recess 46 of the coin carrier wheel 18 when the coin receiving recess 46 is devoid of a coin C and contiguous with the bore 100. As the coin carrier wheel 18 moves in the given direction B, the front end 94A of the stop 94 will ultimately engage an edge segment 34G of the circular body 34 of the coin carrier wheel 18 at the trailing edge of the coin receiving recess 46 and block further rotation of the coin carrier wheel 18 in the given direction B to the location of the backup dog 90 where halting of the coin carrier wheel 18 results in prevention of both forward and reverse rotation of the coin carrier wheel 18 from occurring in either direction from that location (or, for that matter, prevents rotation of the coin carrier wheel 18 even to the location of the coin thickness sensing dog 88 at which location reverse rotation of the coin carrier wheel 18 is still possible). Thus, it can be readily understood that the need for the backup dog 90 is obviated by the AVD 92 of the present invention.

Figure 29:
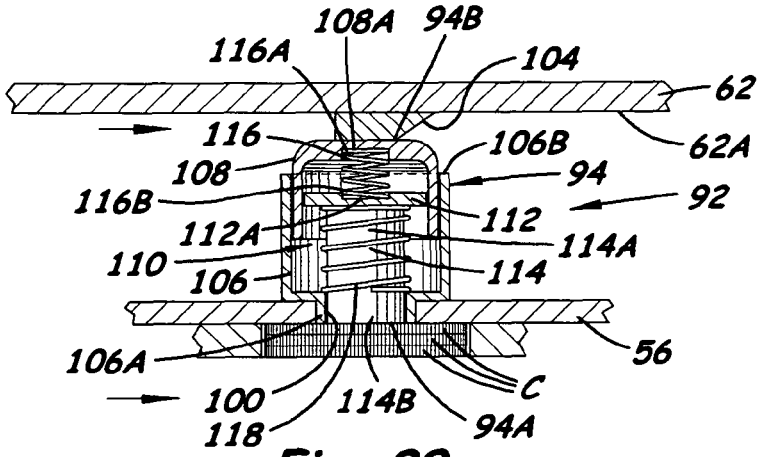
FIG. 29 is still another enlarged cross-sectional view of the anti-vandalism device now showing it not blocking movement of the coin carrier wheel when the required number of coins are present in the coin receiving recess of the coin carrier wheel.

As seen in FIGS. 2, 3, 28 and 29, the actuator 96 of the AVD 92 preferably takes the form of wedge-shaped protuberance 102 attached on the front surface 62A of the ratchet gear wheel 62 which defines an inclined cam surface 104 in a position calculated to engage the rear end 94B of the stop 94 and cause movement, such as depressing, of the stop 94 from its non-blocking position to its blocking position when the coin receiving recess 46 is devoid of a coin and in response to movement of the ratchet gear wheel 62 with the coin carrier wheel 18 from the initial position in the given direction B past the coin periphery sensing dog 74. The stop 94 by being compressible in length allows the actuator 96 to engage the stop 94 and depress it independent of whether a coin is absent from (as seen in FIG. 28) or occupies (as seen in FIG. 29) the coin receiving recess 46. Thus, when the coin receiving recess 46 of the coin carrier wheel 18 has a coin or coins C therein, as seen in FIG. 29) the front end 94A of the stop 94 will engage with the coin C and not protrude from the bore 100. Instead, the length of the stop 94 will compress so as to accommodate its front end 94A not extending beyond the bore 100 in the coin retainer backplate 20 even though the rear end 94B of the stop 94 is engaged and depressed by the actuator 96 (or cam surface 104) on the ratchet gear wheel 62.

Referring to FIGS. 27 to 29, it can be seen that the extensible and compressible stop 94 includes a hollow cylinder 106 fixedly mounted at a front end 106A on the rear side 56A of the central portion 56 of the coin retainer backplate 20 so as to surround and define the bore 100 therein. The stop 94 also includes a piston cover button 108 of cylindrical shape movably mounted within an open rear end 106B of the cylinder 106 and constituting the rear end 94B of the stop 94, and a piston 110 having a cylindrical head 112 slidably mounted within the cylinder 106 and an elongated stem 114 attached at an inner end 114A to the head 112 and extending to an outer end 114B disposed within the bore 100 in the coin retainer backplate 20 and constituting the front end 94A of the stop 94. The stop 94 further includes a first coin spring 116 extending between and disposed at opposite ends 116A, 116B in respective depressions 108A, 112A in the piston cover button 108 and the head 112 of the piston 100. The first coin spring 116 in response to engagement of the piston cover button 108 by the cam surface 104 on the wedge-shaped protuberances 102 of the actuator 96 on the ratchet gear wheel 62 is sufficiently stiff so as to transmit to the piston 110 the depressing movement of the piston cover button 108 into the cylinder 106 so as to cause projection of the outer end 114B of the piston stem 114 beyond the bore 100 in the coin retainer backplate 20 in absence of a coin C in the coin receiving recess 46 of the coin carrier wheel 18, as shown in FIG. 28. Also the first coil spring 116 is sufficiently yieldable to absorb such depressing movement of the piston cover button 108 without transmitting the same to the piston 110 in the event of there being a coin C in the coin receiving recess 46 of the coin carrier wheel 18, as shown in FIG. 29. The stop 94 still further includes a second coil spring 118 extending about the piston stem 114 between the head 112 of the piston 110 and the rear side 56A of the central portion 56 of the coin retainer backplate 20 and around the bore 100 therein such that the second coil spring 114 from beyond the coin retainer backplate 20 and into the bore 100 thereof and movement of the piston 110 and the piston cover button 108 away from the coin retainer backplate 20 upon disengagement of the piston cover button 108 by the cam surface 104 on the wedge-shaped protuberance 102 of the actuator 96 on the ratchet gear wheel 62.

It is thought that the present invention and its advantages will be understood from the foregoing description and it will be apparent that various changes may be made thereto without departing from the spirit and scope of the invention or sacrificing all of its material advantages, the form hereinbefore described being merely a preferred or exemplary embodiment thereto.

The invention claimed is:

1. A multi-coin operated actuation mechanism for a vending machine, comprising:

(a) a cover plate having a rear recessed cavity at a rear side thereof, with a central axis extending through said cavity, and at least one coin insertion slot defined through an upper portion of said cover plate and in communication with said cavity such that said coin insertion slot is disposed in spaced relation to and above said central axis;

(b) a coin carrier wheel disposed in said cavity of said cover plate to undergo rotation relative to said cover plate and about said central axis in a given direction, said coin carrier wheel including (i) a body having a peripheral edge and front and rear sides, (ii) at least one coin receiving recess defined into said rear side of said body so as to have outer opposite leading and trailing ends in said given direction of rotation of said coin carrier wheel and forming therebetween in a side-by-side relationship at least one coin non-accepting region adjacent to a plurality of coin accepting regions which extend to and open at said peripheral edge of said body and are spaced from said axis such that said coin receiving recess is alignable with said coin insertion slot in said cover plate when said coin carrier wheel is disposed at a home position, said coin accepting regions of said coin receiving recess having a combined predetermined width such that when said coin carrier wheel is at said home position a set of a preselected number of multiple coins can be deposited through said coin insertion slot into said plurality of coin accepting regions of said coin receiving recess adjacent to said at least one coin non-accepting region of said coin receiving recess, and (iii) respective outer segments on said peripheral edge of said body disposed adjacent to said opposite leading and trailing ends of said coin receiving recess in said given direction of rotation of said coin carrier wheel, said outer segment adjacent to said trailing end of said coin receiving recess defining an abutment surface and a camming surface being correspondingly aligned with said plurality of coin accepting regions and said at least one coin non-accepting region adjacent to said plurality of coin accepting regions;

(c) a coin retainer plate attached to said cover plate and extending across said rear recessed cavity of said cover plate so as to be stationarily disposed adjacent to said rear side of said coin carrier wheel such that said coin retainer plate retains the set of multiple coins in said coin receiving recess of said coin carrier wheel as said coin carrier wheel is rotated in said given direction from said home position to a discharge location; and (d) a coin diameter checking device including a set of multiple coin periphery sensing dogs pivotally mounted in a side-by-side position with respect to one another in said cavity of said cover plate and adjacent to said coin carrier wheel with said coin dogs having respective outer tip surfaces substantially identical in configuration with one another and matching in number and correspondingly aligned with and adapted to respectively engage said outer segment on said peripheral edge of said body of said coin carrier wheel defining said abutment surface and said camming surface at said outer trailing end of said coin receiving recess in said body of said coin carrier wheel, said coin dogs preventing said coin receiving recess to move past said coin dogs in said given direction in response to any of the multiple coins not being deposited into said coin accepting regions of said coin receiving recess by said coin dogs each being pivotal toward and away from said coin carrier wheel and into contact therewith, said outer tip surfaces of said coin dogs having said substantially identical configurations functioning as cam followers adapting each of said coin dogs to make contact with and ride over one of the multiple coins when deposited in said coin receiving recess and thus not engage with said corresponding abutment surface at said trailing end of said coin accepting regions of said coin receiving recess of said coin carrier wheel and to make contact with and ride over said corresponding camming surface at said trailing end of said at least one coin non-accepting region of said coin receiving recess of said coin carrier wheel adjacent to said plurality of coin accepting regions.

2. The actuation mechanism of claim 1 wherein said coin diameter sensing device further includes a housing removably mounted to said cover plate at least partially within said rear recessed cavity therein and adjacent to said coin carrier wheel, said set of multiple coin periphery sensing dogs pivotally mounted in a side-by-side position with respect to one another in said housing such that said dogs together with said housing constitute a unit removably mounted to said cover plate.

3. The actuation mechanism of claim 1 wherein said coin carrier wheel is one or the other of a pair of interchangeable coin carrier wheels, said one having said coin receiving recess of a different width than said coin receiving recess of said other due to said coin receiving recess of said one being formed with fewer coin accepting regions than said other and having a camming surface at said outer segment on said peripheral edge of said one aligned with a coin non-accepting region of said recess of said one rather than an abutment surface at said outer trailing end of said coin receiving recess of said other.

4. The actuation mechanism of claim 1 further comprising:

a backup detent movably mounted to said cover plate adjacent to said coin carrier wheel and within said rear recessed cavity and angularly displaced from said set of multiple coin dogs and being adapted to engage said coin carrier wheel at said abutments of said coin accepting regions of said coin-receiving recess and halt further movement of said coin carrier wheel in said given direction should operation of said coin dogs be circumvented by an unauthorized act which prevents said outer tip surfaces of said coin dogs from engaging said abutment surfaces of said coin receiving recess when coins are absent therefrom.

5. The actuation mechanism of claim 1 wherein said cover plate includes:

a central body defining said central axis and having a front face and said rear face and a central opening defined therein so as to extend between said front and rear faces and about said central axis; and an outer flange rigidly attached to and extending about a periphery of said central body and projecting rearwardly from said rear face thereof such that said central body and said outer flange together form said rear recessed cavity at said rear side of said cover plate with said central axis extending through said cavity, said at least one coin insertion slot defined through an upper portion of said outer flange and said central body such that said coin insertion slot is disposed in spaced relation to and above said central axis of said central body.

6. The actuation mechanism of claim 5 further comprising:

a central shaft extending from a front end thereof, disposed outwardly from and adjacent to said front face of said central body of said cover plate, through said opening in said central body and through said cavity to a rear end of said shaft disposed rearwardly of said cavity, said central shaft being rotatably mounted to said central body of said cover plate through said opening and extending co-axially along said central axis of said cover plate, said coin carrier wheel being fitted on and mounted over said central shaft between said front end and rear end of said shaft.

7. The actuation mechanism of claim 6 further comprising:

a transverse handle fixedly attached to said front end of said central shaft and disposed adjacent to said front face of said central body of said cover plate such that said handle may be turned by a user to rotate said central shaft and said coin carrier wheel therewith about said central axis in said given direction.

8. The actuation mechanism of claim 6 further comprising:

a ratchet device including a ratchet wheel fixedly mounted to said rear end of said central shaft, and a spring-loaded pawl pivotally mounted to said retainer plate adjacent to said ratchet wheel, said pawl being positioned to engage in successive notches defined about said ratchet wheel such that said central shaft, ratchet wheel and coin carrier wheel can only be rotated in said given direction once that said central shaft has rotated sufficiently to bring said pawl into engagement with a first of said notches on said ratchet wheel which then prevents reverse rotation of said central shaft, ratchet wheel and coin carrier wheel.

9. A multi-coin operated actuation mechanism for a vending machine, comprising:

(a) a cover plate including a rear recessed cavity at a rear side thereof with said central axis extending through said cavity, and at least one coin insertion slot defined through an upper portion of said cover plate and in communication with said cavity such that said coin insertion slot is disposed in spaced relation to and above said central axis;

(b) a coin carrier wheel is disposed in said cavity of said cover plate to undergo rotation relative to said cover plate and about said central axis in a given direction, said coin carrier wheel including (i) a substantially circular body having a peripheral edge and front and rear sides, (ii) first and second coin receiving recesses defined into said rear side of said circular body so as to each have outer opposite leading and trailing ends in said given direction of rotation of said coin carrier wheel, at least one of said first and second coin receiving recesses forming in a side-by-side relationship between said opposite leading and trailing ends at least one coin non-accepting region adjacent to a plurality of coin accepting regions which extend to and open at said peripheral edge of said body, said first and second coin receiving recesses being angularly displaced from one another about said axis such that said first and second coin receiving recesses are separately alignable with said coin insertion slot in said cover plate when said coin carrier wheel is rotated about said central axis in said given direction respectively from a leading position in which said first coin receiving recess is aligned with said coin insertion slot to a trailing position in which said second coin receiving recess is aligned with said coin insertion slot, said first and second coin receiving recesses having predetermined widths such that first and second sets of preselected numbers of multiple coins can be deposited through said coin insertion slot into coin accepting regions of said first and second coin receiving recesses when said coin carrier wheel is respectively at said leading and trailing positions, one of said sets of preselected numbers of multiple coins being deposited through said coin insertion slot into coin accepting regions of said at least one of said first and second coin receiving recesses adjacent to said at least one coin non-accepting region thereof, and (iii) respective outer segments on said peripheral edge of said circular body disposed adjacent to said opposite leading and trailing ends of each of said first and second coin receiving recesses in said given direction of rotation of said coin carrier wheel, said outer segment adjacent to said trailing end of said at least one of said first and second coin receiving recesses defining an abutment surface and a camming surface being correspondingly aligned with said plurality of coin accepting regions and said at least one coin non-accepting region adjacent to said plurality of coin accepting regions;

(c) a coin retainer plate attached to said cover plate and extending across said rear recessed cavity of said cover plate so as to be stationarily disposed adjacent to said rear side of said coin carrier wheel such that said coin retainer plate retains the first and second sets of multiple coins in said first and second coin receiving recesses of said coin carrier wheel as said coin carrier wheel is rotated in said given direction from said leading position through said trailing position to a discharge location; and (d) a coin diameter checking device including a set of multiple coin diameter sensing dogs pivotally mounted in a side-by-side position with respect to one another in said cavity of said cover plate and adjacent to said coin carrier wheel with said coin dogs having respective outer tip surfaces being substantially identical in configuration with one another and matching in number and correspondingly aligned with and adapted to respectively engage said outer segment on said peripheral edge of said circular body of said coin carrier wheel defining said abutment surface and said camming surface at said outer trailing end of said at least one of said first and second coin receiving recesses in said circular body of said coin carrier wheel, said coin dogs preventing said coin receiving recesses to move past said coin dogs in said given direction in response to any of first and second sets of multiple coins not being deposited into said coin accepting regions of said first and second coin receiving recesses by said coin dogs each being pivotal toward and away from said coin carrier wheel and into contact therewith, said outer tip surfaces of said coin dogs having said substantially identical configurations functioning as cam followers adapting each of said coin dogs to make contact with and ride over one of the multiple coins when deposited in one of said first and second coin receiving recesses and thus not engage with said corresponding abutment surface at said trailing end of said coin accepting regions of one of said first and second coin receiving recesses of said coin carrier wheel and to make contact with and ride over said corresponding camming surface at said trailing end of said at least one coin non-accepting region of said at least one of said first and second coin receiving recesses of said coin carrier wheel adjacent to a said plurality of coin accepting regions.

10. The actuation mechanism of claim 9 wherein said coin carrier wheel is one or the other of a pair of interchangeable coin carrier wheels, said one having at least one of said coin receiving recesses of a different width than at least one of said coin receiving recesses of said other due to said coin receiving recess of said one being formed with fewer coin accepting regions than said other and having a camming surface at said outer segment on said peripheral edge of said one aligned with a coin non-accepting region of said recess of said one rather than an abutment surface at said outer trailing end of said coin receiving recess of said other.

11. The actuation mechanism of claim 9 wherein said coin diameter sensing device further includes a housing removably mounted to said cover plate at least partially within said rear recessed cavity therein and adjacent to said coin carrier wheel, said set of multiple coin periphery sensing dogs pivotally mounted in a side-by-side position with respect to one another in said housing such that said dogs together with said housing constitute a unit removably mounted to said cover plate.

12. The actuation mechanism of claim 9 further comprising:

a backup detent movably mounted to said cover plate adjacent to said coin carrier wheel and within said rear recessed cavity and angularly displaced from said set of multiple coin dogs and being adapted to engage said coin carrier wheel at said abutments of said coin accepting regions of said first and second coin-receiving recesses and halt further movement of said coin carrier wheel in said given direction should operation of said coin dogs be circumvented by an unauthorized act which prevents said outer tip surfaces of said coin dogs from engaging said abutment surfaces of said coin receiving recess when coins are absent therefrom.

13. The actuation mechanism of claim 9 wherein said cover plate includes:

a central body defining a central axis and having front and rear faces and a central opening defined therein so as to extend between said front and rear faces and about said central axis; and an outer flange rigidly attached to and extending about a periphery of said central body and projecting rearwardly from said rear face thereof such that said central body and said outer flange together form a rear recessed cavity at a rear side of said cover plate with said central axis extending through said cavity, said at least one coin insertion slot defined through an upper portion of said outer flange and said central body such that said coin insertion slot is disposed in spaced relation to and above said central axis of said central body.

14. The actuation mechanism of claim 13 further comprising:

a central shaft extending from a front end thereof, disposed outwardly from and adjacent to said front face of said central body of said cover plate, through said opening in said central body and through said cavity to a rear end of said shaft disposed rearwardly of said cavity, said central shaft being rotatably mounted to said central body of said cover plate through said opening and extending co-axially along said central axis of said cover plate, said coin carrier wheel being fitted on and mounted over said central shaft between said front end and rear end of said shaft.

15. The actuation mechanism of claim 14 further comprising:

a transverse handle fixedly attached to said front end of said central shaft and disposed adjacent to said front face of said central body of said cover plate such that said handle may be turned by a user to rotate said central shaft and said coin carrier wheel therewith about said central axis in said given direction.

16. The actuation mechanism of claim 14 further comprising:

a ratchet device including a ratchet wheel fixedly mounted to said rear end of said central shaft, and a spring-loaded pawl pivotally mounted to said retainer plate adjacent to said ratchet wheel, said pawl being positioned to engage in successive notches defined about said ratchet wheel such that said central shaft, ratchet wheel and coin carrier wheel can only be rotated in said given direction once that said central shaft has rotated sufficiently to bring said pawl into engagement with a first of said notches on said ratchet wheel which then prevents reverse rotation of said central shaft, ratchet wheel and coin carrier wheel.

17. The actuation mechanism of claim 9 wherein said coin carrier wheel has a relief surface on said periphery thereof at said outer leading end of said first and second coin receiving recesses being a lesser distance from said central axis than said abutment surface or camming surface at said outer trailing end of said first and second coin receiving recesses so as to allow a reduction in the magnitude of force that needs to be applied against said dogs by said coin carrier wheel thereby requiring less strength for rotating said coin carrier wheel in said given direction.

* * * * *